US011221137B2

(12) United States Patent
Bucher et al.

(10) Patent No.: US 11,221,137 B2
(45) Date of Patent: Jan. 11, 2022

(54) FIELD INSTALLED PERFORATED FLAME HOLDER AND METHOD OF ASSEMBLY AND INSTALLATION

(71) Applicant: ClearSign Combustion Corporation, Seattle, WA (US)

(72) Inventors: Jonathan Bucher, Kenmore, WA (US); Donald Kendrick, Bellevue, WA (US); James K. Dansie, Renton, WA (US); Douglas W. Karkow, Mount Vernon, IA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 231 days.

(21) Appl. No.: 16/558,853

(22) Filed: Sep. 3, 2019

(65) Prior Publication Data

US 2020/0056782 A1 Feb. 20, 2020

Related U.S. Application Data

(63) Continuation of application No. PCT/US2018/020523, filed on Mar. 1, 2018.
(Continued)

(51) Int. Cl.
*F23D 14/26* (2006.01)
*F23D 14/58* (2006.01)
(Continued)

(52) U.S. Cl.
CPC ..... *F23D 14/26* (2013.01); *F23D 14/58* (2013.01); *F23D 14/70* (2013.01); *F27D 1/0009* (2013.01);
(Continued)

(58) Field of Classification Search
CPC ..... F27D 1/0009; F27D 1/18; F27D 1/0033; F27D 2001/0059; F23D 2203/102;
(Continued)

(56) References Cited

U.S. PATENT DOCUMENTS 3,439,996 A 4/1969 Lherault et al.
4,413,976 A 11/1983 Scherer
(Continued)

FOREIGN PATENT DOCUMENTS

CN 101046304 10/2007
FR 1151211 1/1958
FR 2503836 10/1982

OTHER PUBLICATIONS

PCT International Search Report and Written Opinion dated Jun. 20, 2018, for PCT International Patent Application Mo. PCT/US2018/020523, filed Mar. 1, 2018, 19 pages.

*Primary Examiner* — Avinash A Savani
(74) *Attorney, Agent, or Firm* — Christopher A. Wiklof; Launchpad IP, Inc.

(57) ABSTRACT

A flame holder system includes a support structure configured to support a plurality of burner tiles within a furnace volume. The support structure includes a frame supporting a support lattice. A number of burner tiles are arranged in an array on the support lattice. The support structure is configured to be assemblable without tools inside the furnace volume, using components that are sized to fit through an access port in a wall of the furnace.

48 Claims, 9 Drawing Sheets

Related U.S. Application Data

(60) Provisional application No. 62/466,525, filed on Mar. 3, 2017.

(51) Int. Cl.
*F23D 14/70* (2006.01)
*F27D 1/00* (2006.01)
*F27D 1/18* (2006.01)

(52) U.S. Cl.
CPC ..... *F27D 1/0033* (2013.01); *F27D 1/18* (2013.01); *F23D 2203/102* (2013.01); *F23D 2203/104* (2013.01); *F23D 2212/101* (2013.01); *F23D 2212/103* (2013.01); *F27D 2001/0059* (2013.01)

(58) Field of Classification Search
CPC ..... F23D 2203/104; F23D 2212/101; F23D 2212/103
USPC ..... 431/328
See application file for complete search history.

(56) References Cited

U.S. PATENT DOCUMENTS 4,473,349 A 9/1984 Kumatsu
4,483,673 A 11/1984 Murai et al.
4,724,671 A 2/1988 Lapergue et al.
4,799,879 A * 1/1989 Laspeyres ..... F23D 14/14 431/328
4,889,061 A * 12/1989 McPherson ..... F23G 5/34 110/336
5,275,552 A 1/1994 Schwartz et al.
5,326,257 A 7/1994 Taylor et al.
5,409,375 A 4/1995 Butcher
5,423,294 A * 6/1995 Cole ..... F22B 37/108 122/512
5,439,372 A 8/1995 Duret et al.
5,441,402 A 8/1995 Reuther et al.
5,511,516 A 4/1996 Moore, Jr. et al.
5,641,282 A 6/1997 Lee et al.
5,667,374 A 9/1997 Nutcher et al.
5,993,192 A 11/1999 Schmidt et al.
6,514,071 B1 * 2/2003 Meyer ..... F23D 14/145 126/92 AC
2012/0164590 A1 6/2012 Mach
2012/0231398 A1 9/2012 Carpentier et al.
2014/0227645 A1 8/2014 Krichtafovitch et al.
2015/0316261 A1 11/2015 Karkow et al.
2016/0003471 A1 1/2016 Karkow et al.
2016/0230984 A1 8/2016 Colannino et al.
2016/0238242 A1 8/2016 Karkow et al.
2017/0038063 A1 2/2017 Colannino et al.
2017/0146232 A1 5/2017 Karkow et al.
2017/0184303 A1 6/2017 Colannino et al.
2017/0268772 A1 9/2017 Lang, Sr. et al.
2017/0307212 A1 10/2017 Kendrick
2017/0350591 A1 12/2017 Karkow et al.
2018/0023810 A1 1/2018 Karkow et al.
2018/0066846 A1 3/2018 Karkow et al.
2018/0087774 A1 3/2018 Karkow et al.
2018/0202653 A1 7/2018 Karkow
2019/0049107 A1 2/2019 Colannino et al.
2019/0107331 A1 4/2019 Kendrick et al.
2019/0137096 A1 5/2019 Kendrick et al.
2019/0257516 A1 8/2019 Karkow et al.

* cited by examiner

FIELD INSTALLED PERFORATED FLAME HOLDER AND METHOD OF ASSEMBLY AND INSTALLATION

CROSS REFERENCE TO RELATED APPLICATIONS

The present application is a Continuation Application which claims priority benefit under 35 U.S.C. § 120 (pre-AIA) of co-pending International Patent Application No. PCT/US2018/020523, entitled "FIELD INSTALLED PERFORATED FLAME HOLDER AND METHOD OF ASSEMBLY AND INSTALLATION," filed Mar. 1, 2018. International Patent Application No. PCT/US2018/020523 claims priority benefit from U.S. Provisional Patent Application No. 62/466,525, entitled "FIELD INSTALLED PERFORATED FLAME HOLDER AND METHOD OF ASSEMBLY AND INSTALLATION," filed Mar. 3, 2017. Each of the foregoing applications, to the extent not inconsistent with the disclosure herein, is incorporated by reference.

BACKGROUND

Industrial furnaces and boilers are subject to regulations and conditions that impose ever-increasing limitations on emissions and operations.

SUMMARY

According to an embodiment, a flame holder system is provided, which includes a support structure configured to support a plurality of burner tiles within a furnace volume. The support structure includes a frame supporting a support lattice. A plurality of burner tiles are arranged in an array on the support lattice.

According to an embodiment, the support structure is configured to be assemblable by hand and without the use of tools inside the furnace volume, using components that are sized to fit through an access port in a wall of the furnace.

According to an embodiment, a furnace is provided, in which the flame holder system is supported in the furnace volume on a plurality of support brackets coupled to walls of the furnace and extending into the furnace volume.

According to an embodiment, the plurality of burner tiles are separably arranged in the array on the support lattice.

According to an embodiment, the frame includes frame members and connecting members. A first plurality of the frame members extend parallel to a first axis and a second plurality of the frame members extend parallel to a second axis, perpendicular to the first axis. Each of the first plurality of the frame members is configured to lockingly engage a respective one of the connecting members at both ends. Each of the plurality of the connecting members includes locking apertures, and the ends of each of the first plurality of the frame members are configured to pass into and lockingly engage the locking apertures of the plurality of the connecting members.

According to an embodiment, each of the first plurality of the frame members includes at least one locking tab at each end, and many of the first plurality of the frame members include two or more locking tabs at or near each end. The locking aperture of each of the plurality of the connecting members has a keyhole shape configured to receive an end of one of the first plurality of the frame members at a particular orientation. Rotation of a frame member away from the particular orientation while the frame member is positioned within a locking aperture of a connecting member locks the frame member to the connecting member.

According to an embodiment, the support lattice includes a plurality of the support members that are positioned on the frame and interconnected by additional connecting members.

According to an embodiment, the connecting members are plates that extend beyond a plane defined by the support members of the support lattice, thereby providing a barrier that constrains movement of the burner tiles that rest on the support lattice.

According to an embodiment, a method is provided for installing a flame holder assembly in a preexisting furnace. The method includes passing components of the flame holder assembly into the furnace volume via a service access port in the furnace wall, assembling a support frame inside the furnace by hand and without tools, securing the support frame within the furnace, and assembling a support lattice on the support frame.

According to an embodiment, individual tiles are passed between support elements of the support lattice from below the support frame and positioned to rest on the support lattice. The tiles are arranged in an array on the support lattice by reaching between the support members and separately positioning each of the burner tiles on the support lattice.

According to an embodiment, a system includes a support structure configured to support a plurality of burner tiles within a furnace volume. The support structure includes a frame including frame members configured to be assembled on location and a support lattice having a plurality of support members sized to span the frame and configured to be assembled on location with the frame. The system includes a flame holder including a plurality of burner tiles configured to be assembled into an array on location. The flame holder is supported within the furnace volume by the support lattice.

According to an embodiment, a method includes assembling a support structure inside of a furnace volume. Assembling the support structure includes assembling a frame inside the furnace volume, supporting the frame within the furnace volume, and assembling a support lattice on the supported frame, positioning each of a plurality of burner tiles on the support lattice, and separably arranging the plurality of burner tiles into an array on the support lattice.

According to an embodiment, a system includes a support structure configured to support a plurality of burner tiles within a furnace volume. The support structure includes a frame including frame members configured to be assembled by hand and fastened together without the use of hand tools. The support structure includes a support lattice having a plurality of support members sized to span the frame and configured to be assembled with the frame by hand and fastened together without the use of hand tools.

According to an embodiment, a system includes a support structure configured to support a plurality of burner tiles within a furnace volume. The support structure includes a frame including frame members made entirely of refractory ceramic, a support lattice having a plurality of support members sized to span the frame, made entirely of refractory ceramic, and a plurality of connecting members configured to couple the frame members and the support members together, the connecting members being made entirely of refractory ceramic.

DETAILED DESCRIPTION

Figure 1:
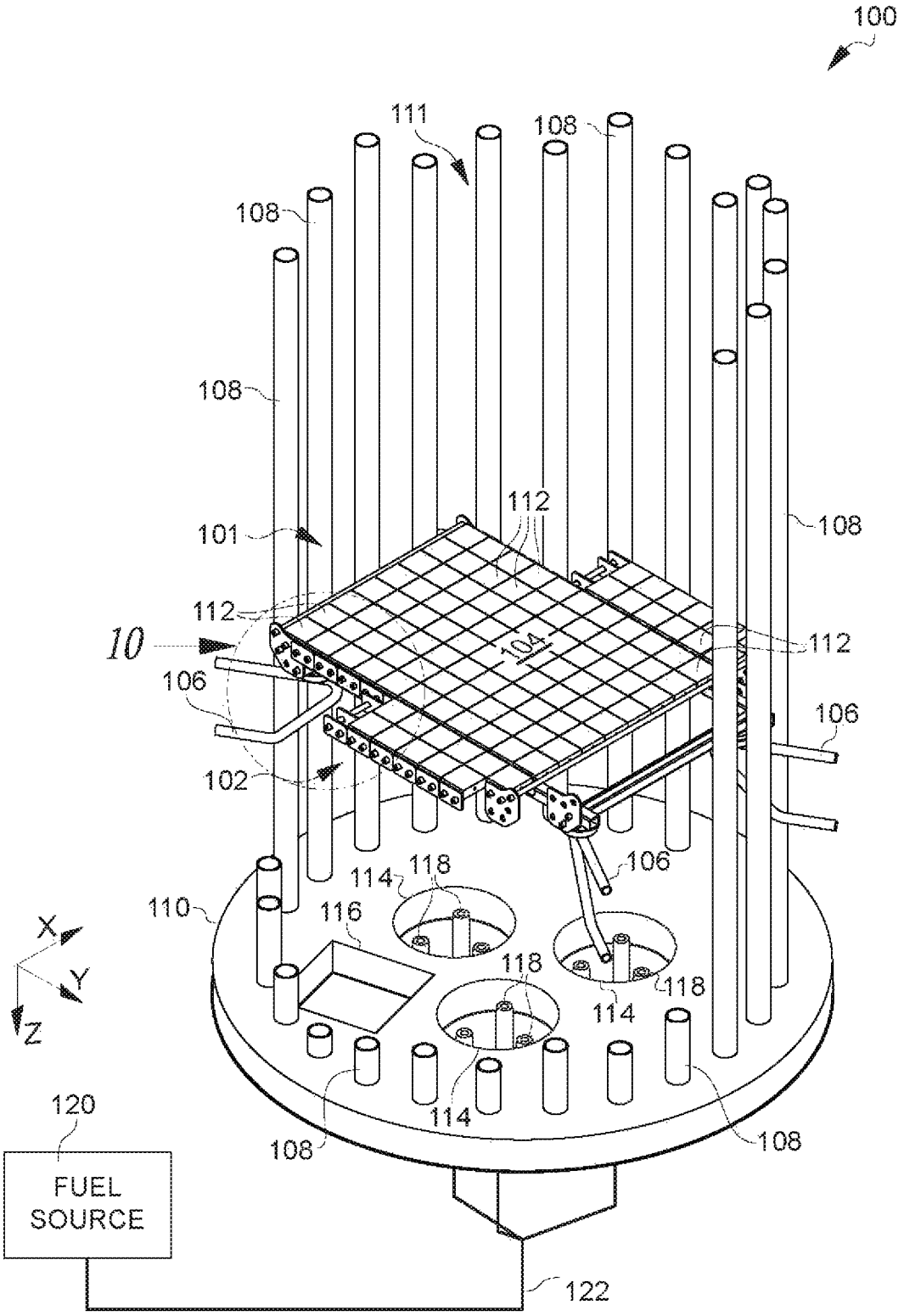
FIG. 1 is a simplified perspective view of a commercial furnace, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

In many of the drawings, elements are designated with a reference number followed by a letter, e.g., "112*a*." In such cases, the letter designation is used where it may be useful in the corresponding description to differentiate between, or to refer to specific ones of a number of otherwise similar or identical elements. Where the description omits the letter from a reference, and refers to such elements by number only, this can be understood as a general reference to all the elements identified by that reference number, unless other distinguishing language is used.

FIG. 1 is a simplified perspective view of a boiler furnace 100, according to an embodiment. Walls of the furnace 100 are not shown, and other portions are cut away to better show a flame holder assembly 101 positioned within the furnace 100. The flame holder assembly 101 includes a flame holder 102 positioned on a flame holder support assembly 104, which is supported, in turn, by a plurality of support brackets 106. The furnace 100 includes a cylindrical "tube sheet," i.e., a plurality of process tubes 108 passing through a floor 110 of the furnace 100, extending vertically through the furnace volume 111 and configured to receive radiant and convective heat from combustion within the furnace volume 111. The flame holder 102 comprises a plurality of burner tiles 112 arranged in an array and positioned on the flame holder support assembly 104. The support brackets 106 are coupled to walls of the furnace 100 and extend between respective pairs of the process tubes 108, to support the flame holder assembly 101 within the cylinder formed by the plurality of process tubes 108.

The floor 110 of the furnace 100 is penetrated by a plurality of burner apertures 114 and a service access port 116. The service access port 116 is sized to permit a service worker to enter the cylindrical space formed by the plurality of process tubes 108 without the need to remove any of the process tubes 108. Burner nozzles 118 are positioned in the burner apertures 114, configured to emit respective fuel streams into the furnace volume 111 to fuel a combustion reaction supported by the flame holder 102.

According to an embodiment, one or more of the burner tiles 112 is a bluff body burner tile. According to an embodiment, the bluff body burner tile can include a solid bluff body burner tile. According to an embodiment, the bluff body burner tile can include a perforated bluff body burner tile. The perforated bluff body burner tile can include a reticulated ceramic bluff body burner tile. The flame holder 102 can include a mixture of solid bluff body burner tiles and perforated bluff body burner tiles.

According to one embodiment, the flame holder 102 is a perforated flame holder, configured to support a combustion reaction substantially within apertures extending between top and bottom faces of the flame holder 102. In this case, many or all of the burner tiles may be perforated burner tiles. Details of the structure and operation of a perforated flame holder 102 are provided below, with reference to FIGS. 2-4.

For the purposes of the present disclosure, various directional terms will be used in describing the flame holder assembly 101 and elements thereof. For example, the top of the flame holder assembly 101 is the uppermost surface, as viewed in FIG. 1, while the bottom of the assembly is, for the most part, not visible. Reference to elements as being above or below other elements refers to their relative positions along the X axis. The sides of the flame holder assembly 101 are the edges along the lower left and upper right of the flame holder assembly 101, as viewed in FIG. 1, and thus, sideways movement would be movement along the X axis. The front end of the flame holder assembly 101 is the edge shown at the lower right, while the back end is the edge at the upper left in FIG. 1, so movement forward or backward, or toward either end would be along the Y axis. Where these and related directional terms are used in the description, their intended meaning will be consistent with this explanation, unless a different meaning is clear from the description or the context. The use of such directional terms is for the purpose of reducing the likelihood of confusion, and improving the clarity of the description. The use of such terms in the description does not imply any necessary or essential orientation of a physical device, nor does it limit the claims in any way.

Perforated Flame Holder

Figure 2:
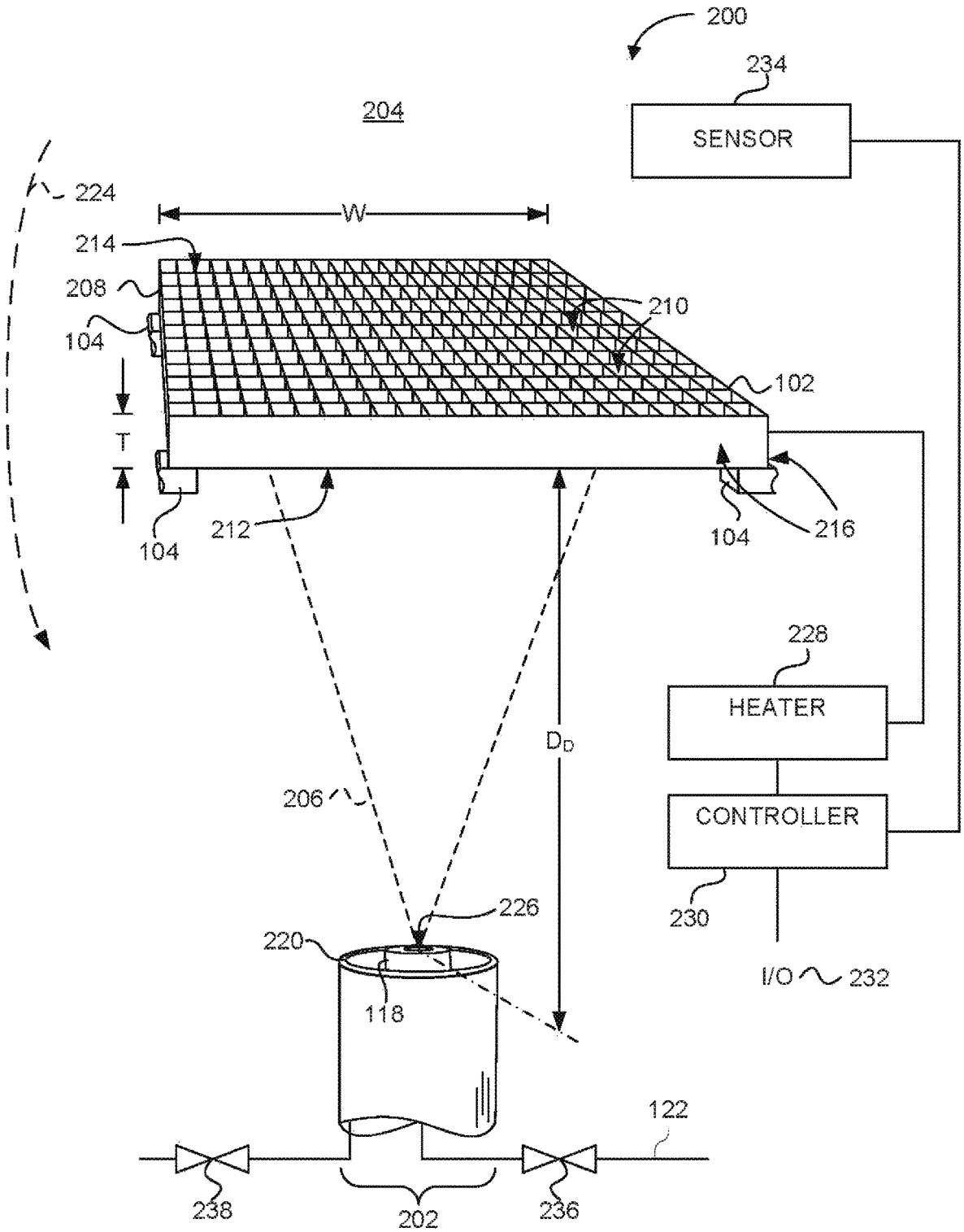
FIG. 2 is a simplified diagram of a burner system including a perforated flame holder configured to hold a combustion reaction, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of burner systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
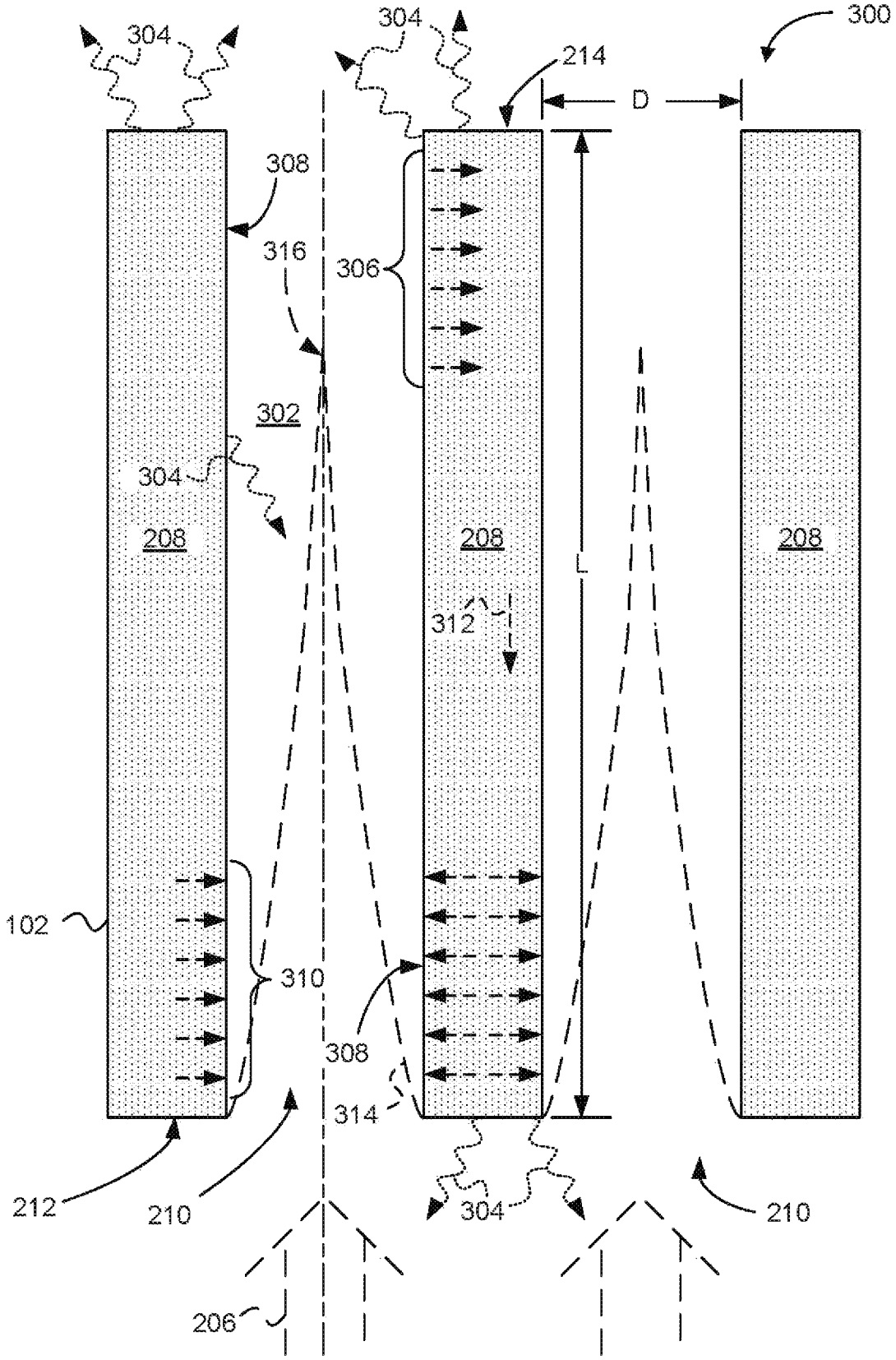
FIG. 3 is a side sectional diagram of a portion of the perforated flame holder of FIGS. 1 and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application, the fuel can include fuel gas or byproducts from the process that include carbon monoxide (CO), hydrogen ($H_2$), and methane ($CH_4$). In another application, the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 118, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc., are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 118, configured to output fuel, and an oxidant source 220 configured to output a fluid including the oxidant. For example, the fuel nozzle 118 can be configured to output pure fuel. The oxidant source 220 can be configured to output combustion air carrying oxygen, and optionally, flue gas.

The perforated flame holder 102 can be held by a perforated flame holder support assembly 104 configured to hold the perforated flame holder 102 at a dilution distance $D_D$ away from the fuel nozzle 118. The fuel nozzle 118 can be configured to emit a fuel jet selected to entrain the oxidant to form the fuel and oxidant mixture 206 as the fuel jet and the oxidant travel along a path to the perforated flame holder 102 through the dilution distance $D_D$ between the fuel nozzle 118 and the perforated flame holder 102. Additionally or alternatively (particularly when a blower is used to deliver oxidant contained in combustion air), the oxidant or combustion air source 220 can be configured to entrain the fuel and the fuel and oxidant mixture 206 travel through the dilution distance $D_D$. In some embodiments, a flue gas recirculation path 224 can be provided. Additionally or alternatively, the fuel nozzle 118 can be configured to emit a fuel jet selected to entrain the oxidant and to entrain flue gas as the fuel jet travels through the dilution distance $D_D$ between the fuel nozzle 118 and the input face 212 of the perforated flame holder 102.

The fuel nozzle 118 can be configured to emit the fuel through one or more fuel orifices 226 having an inside diameter dimension that is referred to as "nozzle diameter." The perforated flame holder support assembly 104 can support the perforated flame holder 102 to receive the fuel and oxidant mixture 206 at the distance $D_D$ away from the fuel nozzle 118 greater than 20 times the nozzle diameter. In another embodiment, the perforated flame holder 102 is disposed to receive the fuel and oxidant mixture 206 at the distance $D_D$ away from the fuel nozzle 118 between 100 times and 1100 times the nozzle diameter. Preferably, the perforated flame holder support assembly 104 is configured to hold the perforated flame holder 102 at a distance about 200 times or more of the nozzle diameter away from the fuel nozzle 118. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The perforated flame holder support structure 104 can be configured to support the perforated flame holder 102 from a floor or wall (not shown) of the combustion volume 204, for example. In another embodiment, the perforated flame holder support assembly 104 supports the perforated flame holder 102 from the fuel and oxidant source 202. Alternatively, the perforated flame holder support structure 104 can suspend the perforated flame holder 102 from an overhead structure (such as a flue, in the case of an up-fired system). The perforated flame holder support structure 104 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support assembly 104 can be configured to support the plurality of perforated flame holder sections. The perforated flame holder support structure 104 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas recirculation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example, the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including the perforated flame holder body 208 and the perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and the output faces 212, 214. In another embodiment, the perforations 210 can be parallel to one another and formed at an angle relative to the input and the output faces 212, 214. In another embodiment, the perforations 210 can be non-parallel to one another. In another embodiment, the perforations 210 can be non-parallel to one another and non-intersecting. In another embodiment, the perforations 210 can be intersecting. The perforated flame holder body 208 can be one piece or can be formed from a plurality of sections, or tiles, as described with reference to various embodiments of the present disclosure.

In another embodiment, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g., Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which the fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e., an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
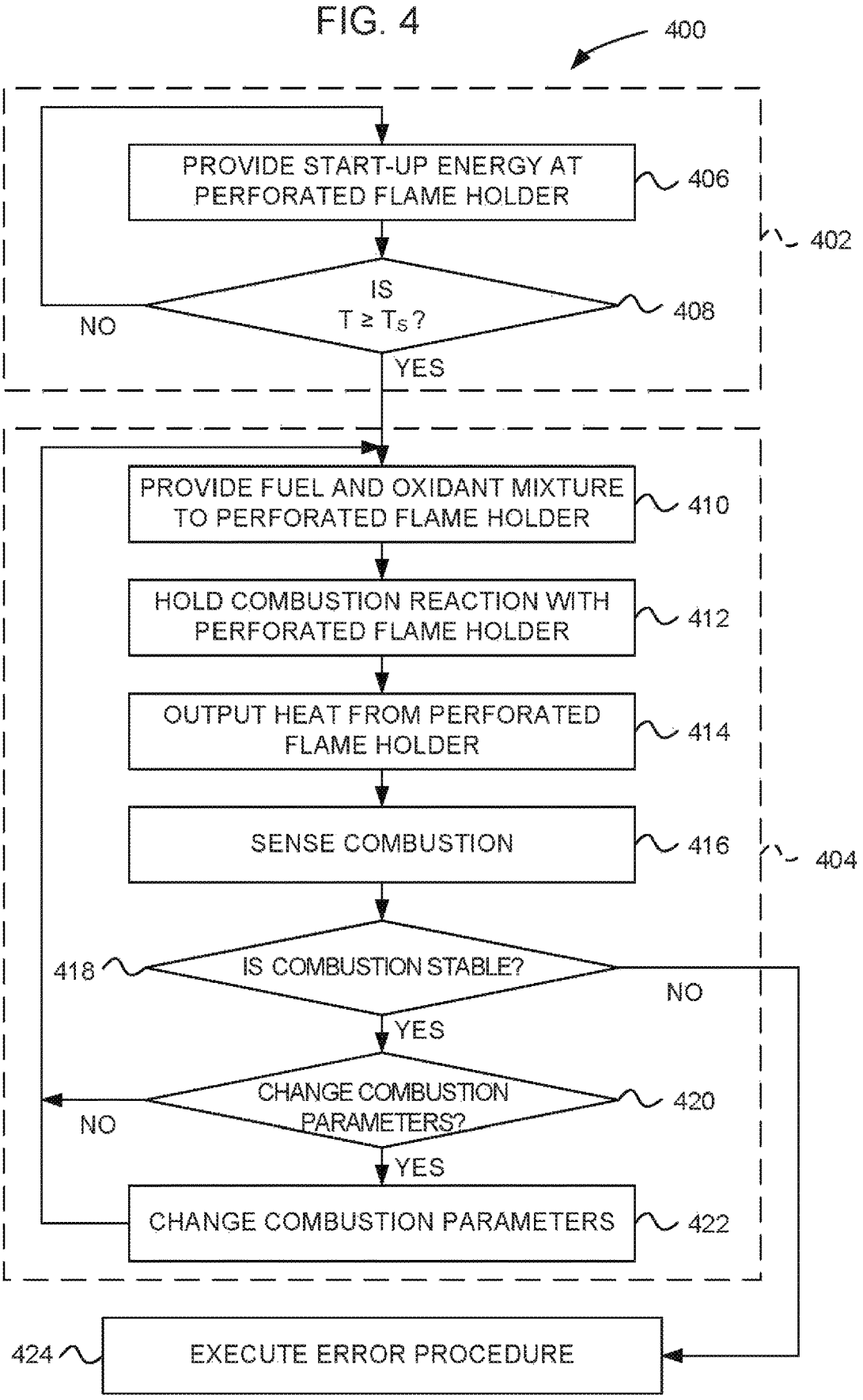
FIG. 4 is a flow chart showing a method, according to an embodiment, for operating a burner system that includes a perforated flame holder similar to the flame holder of FIGS. 2 and 3.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In decision step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from decision step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in decision step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include the fuel nozzle 118 configured to emit the fuel stream 206 and the oxidant source 220 configured to output oxidant (e.g., combustion air) adjacent to the fuel stream 206. The fuel nozzle 118 and the oxidant source 220 can be configured to output the fuel stream 206 to be progressively diluted by the oxidant (e.g., combustion air). The perforated flame holder 102 can be disposed to receive the diluted fuel and oxidant mixture 206 that supports the combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g., microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of the fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of the fuel from a fuel source to the fuel and oxidant source 202. The controller 230 can be configured to control the fuel control valve 236 responsive to input from the combustion sensor 234. The controller 230 can be configured to control the fuel control valve 236 and/or the oxidant blower or damper 238 to control a preheat flame type of heater 228 to heat the perforated flame holder 102 to an operating temperature. The controller 230 can similarly control the fuel control valve 236 and/or the oxidant blower or damper 238 to change the fuel and oxidant mixture 206 flow responsive to a heat demand change received as data via the data interface 232.

Figure 5:
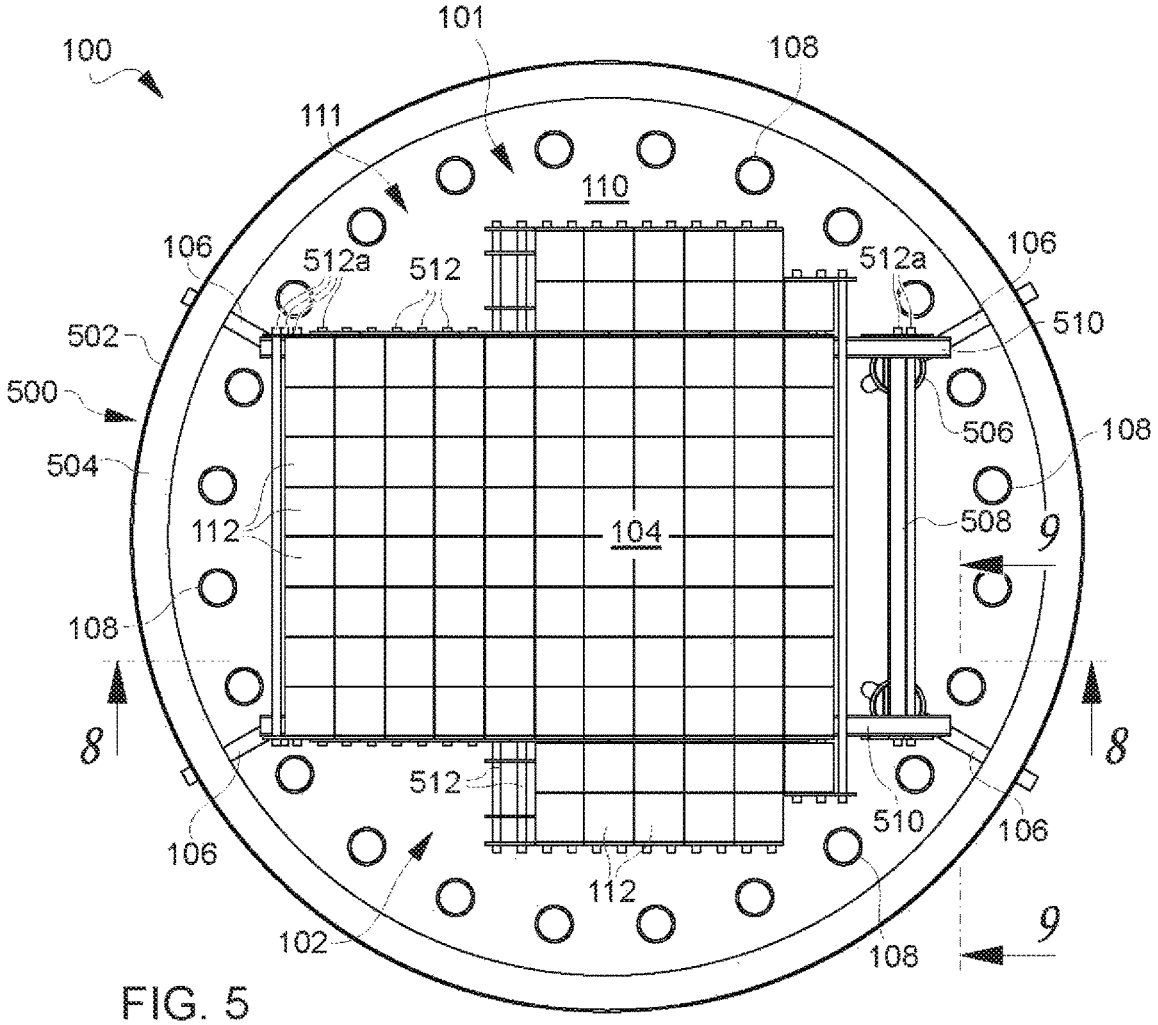
FIG. 5 is a plan view of the furnace of FIG. 1, with upper portions omitted to show the interior of the furnace, according to an embodiment.
Figure 6:
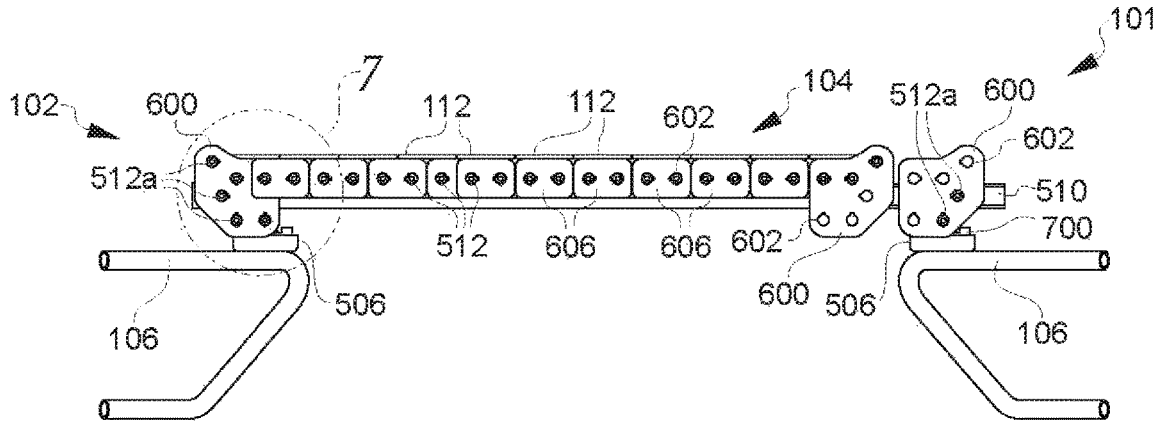
FIG. 6 is a side elevation view of a flame holder assembly of the furnace of FIG. 5, according to an embodiment.
Figure 7:
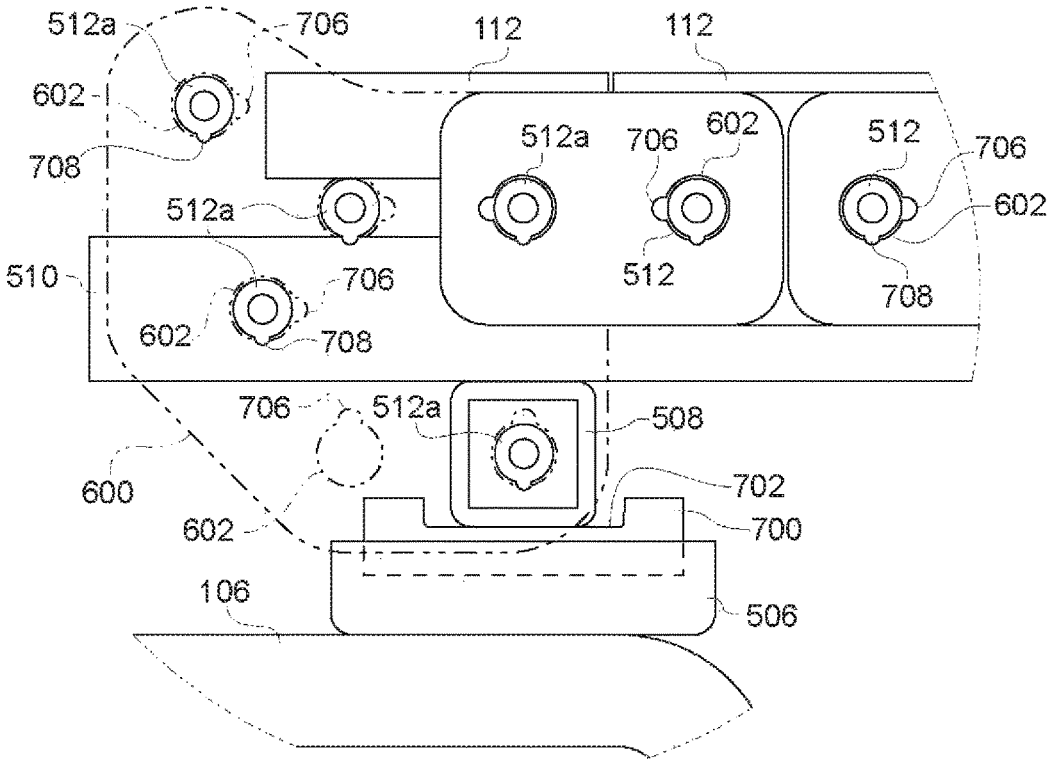
FIG. 7 is an enlarged view of a portion of the flame holder assembly of FIG. 5, as indicated in FIG. 6, at 7, according to an embodiment.
Figure 8:
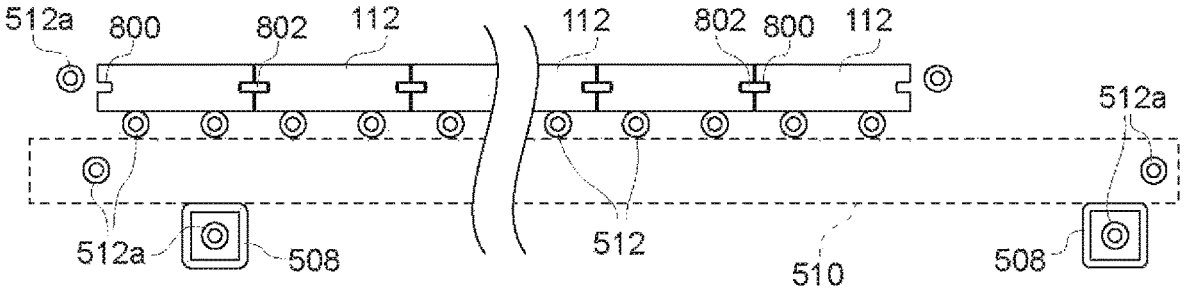
FIG. 8 is a side-sectional diagram of the flame holder assembly of FIG. 5, as viewed along lines 8-8 in FIG. 5, according to an embodiment.
Figure 9:
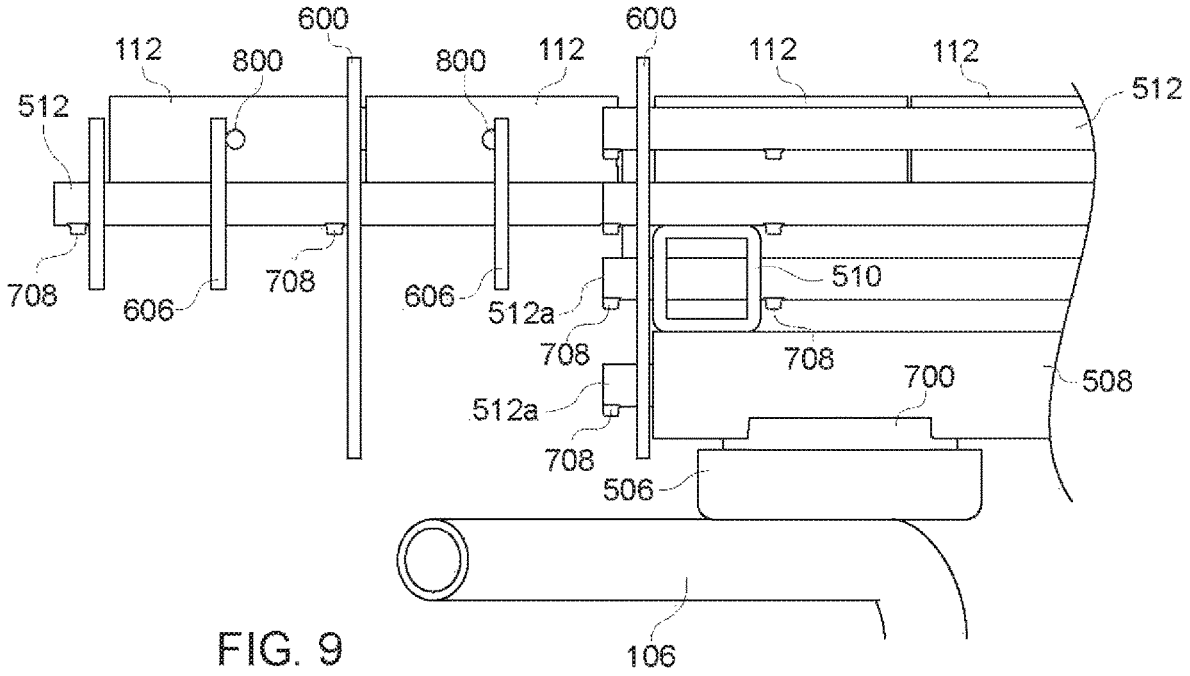
FIG. 9 is an enlarged view of a portion of the flame holder assembly of FIG. 5, as viewed at lines 9-9, according to an embodiment.
Figure 10:
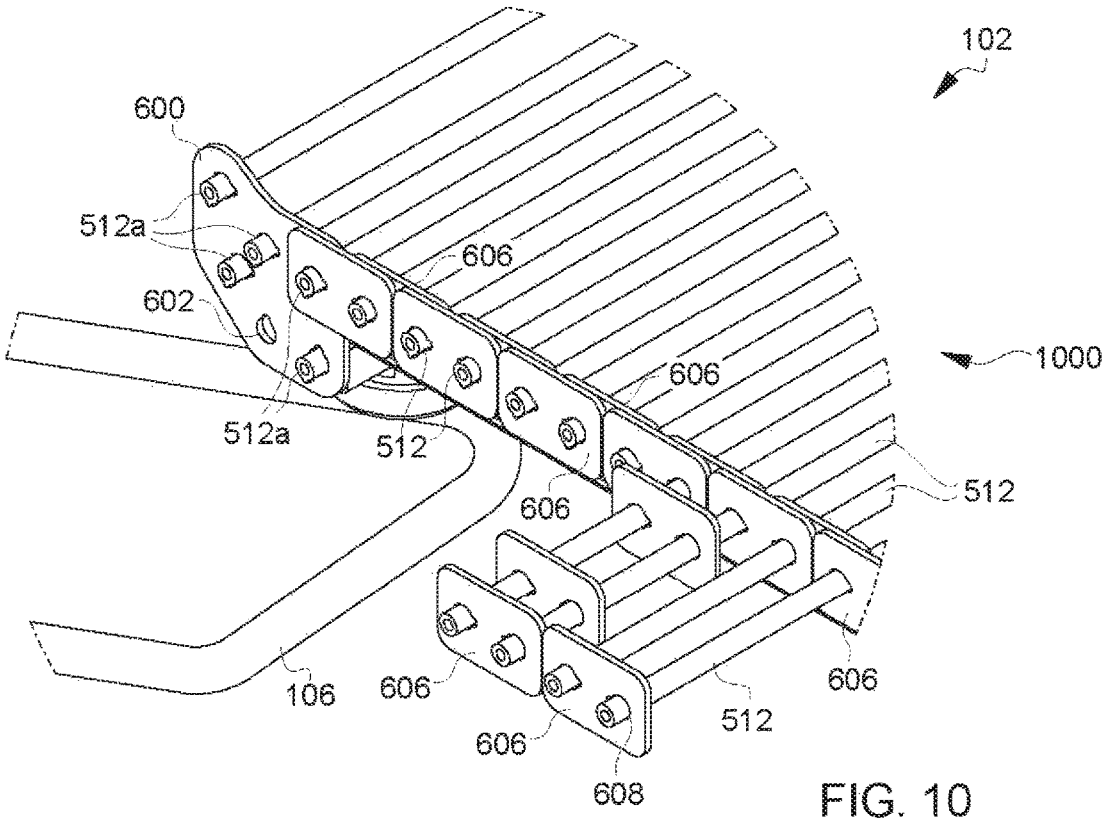
FIG. 10 is an enlarged perspective view of the flame holder support assembly of FIG. 5, showing a portion that corresponds to the portion indicated at 10, in FIG. 1, according to an embodiment.

Details of the flame holder assembly 101 and a method of installing the flame holder assembly are described hereafter with reference to FIGS. 1 and 5-10, which show respective views and details of the furnace 100, according to various embodiments. FIG. 5 is a plan view of the furnace 100, with upper portions omitted to show the interior of the furnace, according to an embodiment. FIG. 6 is a side elevation view of the flame holder assembly 101, according to an embodiment, while FIG. 7 is an enlarged view of a portion of the flame holder assembly 101, as indicated in FIG. 6, at 7, according to an embodiment. FIG. 8 is a side-sectional diagram of the flame holder assembly 101 as viewed along lines 8-8 in FIG. 5, according to an embodiment. FIG. 9 is an enlarged view of a portion of the flame holder assembly 101 as indicated in FIG. 5 at lines 9-9, according to an embodiment. FIG. 10 is an enlarged perspective view of the flame holder support assembly 104, showing a portion that corresponds to the portion indicated at 10, in FIG. 1, according to an embodiment.

Referring to FIG. 5, the furnace 100 includes a cylindrical side wall 500 that encloses the furnace volume 111. The side wall 500 includes an outer, structural layer 502 and an inner, refractory layer 504. The support brackets 106 are affixed to the structural layer 502 and extend between respective pairs of the plurality of process tubes 108 and support the flame holder support assembly 104. The support brackets 106 include respective support pads 506 affixed thereto, configured to receive the flame holder support assembly 104. The support pads 506 can be attached to the support brackets 106 by any appropriate means, including, e.g., by welds, rivets, bolts, etc. Likewise, the support brackets 106 can be attached to the furnace wall 500 by any appropriate means. According to an embodiment, the support brackets 106 are made of stainless steel pipe, and the support pads 506 are also stainless steel. An upper portion of each of the support pads 506 is concave, or recessed, and configured to receive a mating element 700, as shown in hidden (dotted) lines in FIG. 7.

Flame Holder Support Assembly

The flame holder support assembly 104 may include first support beams 508 positioned at the ends of the flame holder support assembly 104 and extending parallel to a first axis, and second support beams 510 positioned at the sides of the flame holder support assembly 104 and extending between the first support beams 508, parallel to a second axis and perpendicular to the first axis. A plurality of support rods 512 extends parallel to the first support beams 508, and forms a support lattice 1000 (see FIG. 10) on which the plurality of burner tiles 112 rest.

In the pictured embodiment, the support rods 512 of the support lattice 1000 are evenly spaced, at a pitch that is equal to about half the lateral dimensions of the burner tiles 112. This ensures that each of the burner tiles 112 will be supported by exactly two of the support rods 512. Additionally, the dimensions of the burner tiles 112, and the spacing of the support rods 512 are selected to be such that a burner tile 112 will fit edgewise between any two adjacent ones of the plurality of support rods 512. Typically, during installation, workers position the burner tiles 112 on the support lattice 1000 from below the flame holder support assembly 104. The ability to introduce burner tiles 112 via the gaps between the support rods 512 is not essential, but it simplifies the process. In other embodiments, at least one location is provided where there is sufficient clearance to introduce the burner tiles 112 onto the support lattice 1000 from below the flame holder support assembly 104. The location can be, for example, a space between a selected pair of support rods 512, an element, such as a support rod 512, that can be installed after the burner tiles 112 have been installed, or simply a space between the flame holder support assembly 104 and the process tubes 108 that is large enough to accommodate a burner tile 112.

The even spacing between the support rods 512 of the support lattice 1000 reduces complexity and simplifies installation. Where the spacing is even, all of the plate ties 606 (see FIG. 6) can be substantially identical. In embodiments in which the spacing of the support rods 512 varies, a set of plate ties 606 is provided having dimensions that correspond to each of the different spacings.

In the embodiment shown, the plurality of support rods 512 includes seven frame rods 512*a*, which, together with the first and second pairs of support beams 508, 510 form a frame on which the support lattice 1000 rests.

Referring to FIG. 6, plate tie ends 600 are positioned opposite each other at respective corners of the flame holder support assembly 104, with ends of the frame rods 512*a* passing through keyhole apertures 602 in the plate tie ends 600—in the enlarged view of FIG. 7, the plate tie end 600 closest to the viewer is transparent, its outline being shown in phantom line to reveal further detail that would otherwise be hidden. Two of the frame rods 512*a* also extend through keyhole apertures 602 in each of the second support beams 510. Another two of the support rods 512 extend lengthwise through respective ones of the first support beams 508, then through keyhole apertures 602 in plate tie ends 600 positioned at opposite ends of the first support beams 508. Each of the mating elements 700 includes a channel 702 in which the first support beams 508 are supported. Each of the first support beams 508 extends between a respective pair of the support brackets 106, resting within the channels 702 of the corresponding mating elements 700. The second support beams 510 rest across the first support beams 508. Although neither of the second support beams 510 lies within the plane defined at 8-8 of FIG. 5, the position of the second support beams 510 on the first support beams 508 is shown in hidden lines in the side-sectional diagram of FIG. 8, for reference.

The remaining ones of the plurality of support rods 512 rest on upper surfaces of the second support beams 510, as shown, for example, in FIG. 8. Plate ties 606 are positioned at opposite ends of those of the plurality of support rods 512 that rest on the second support beams 510, with ends of those support rods 512 extending through keyhole apertures 602 in the plate ties 606. Plate ties 606 are arranged in overlapping rows at opposite ends of the support rods 512, as best seen in FIG. 10, so that most of the support rods 512 pass through the keyhole apertures 602 of two overlapping plate ties 606 at each end. In this way, all of the support rods 512 that rest on the second support beams 510 are connected to each other. Additionally, a number of the plurality of support rods 512 extend some distance beyond the second support beams 510, with additional plate ties 606 and another pair of plate tie ends 600 positioned at their extreme ends. Thus, a portion of the support lattice 1000 formed by the plurality of support rods 512 is cantilevered beyond the second support beams 510, on either side of the flame holder support assembly 104.

Each of the keyhole apertures 602 includes a locking feature 706. The support rods 512 include tabs 708 configured to engage the locking features 706 of keyhole apertures 602 through which they pass. During installation of the flame holder support assembly 104, each support rod 512 must be oriented so that the tabs 708 align with the respective locking features 706 in order for the support rod 512 to be inserted through the corresponding keyhole aperture 602. Once the support rods 512 are properly positioned, the support rods 512 are rotated to unalign the tabs 708 and locking features 706, locking the elements in place and ensuring that they remain connected during normal operation of the furnace 100. In general, the keyhole apertures 602 are oriented so that the locking features 706 extend upward or to one or the other side of the respective keyhole aperture 602. Thus, unalignment of the tabs 708 can be done simply by rotating each support rod 512 until its tabs 708 are positioned at the bottom of the respective support rod 512.

As can be seen in FIG. 9, each of the support rods 512 includes a tab 708 at the end shown, which serves to prevent any of the plate tie ends 600 or plate ties 606 from sliding off the ends of the support rods 512 during normal operation of the furnace 100. However, each of the support rods 512 also includes one or more additional tabs 708 spaced further inward from the end. These tabs 708 serve primarily to hold selected components of the flame holder support assembly 104 in their proper relative positions during installation of the flame holder assembly 101 into the furnace 100, as will be described in greater detail later. The support rods 512 are preferably symmetrical, meaning that the arrangement of tabs 708 at one end of a support rod 512 is mirrored by a similar arrangement of tabs 708 at the opposite end.

According to an embodiment, the keyhole apertures 602 are sized such that the support rods 512 fit loosely in the keyhole apertures 602. For example, in the pictured embodiment, the support rods 512 are about 1" in diameter, while the primary diameter of the keyhole apertures 602 is about 1.125" (1⅛").

According to a preferred embodiment, components of the flame holder support assembly 104, including the support rods 512, the first and second support beams 508, 510, the plate tie ends 600, and the plate ties 606, are a refractory ceramic material selected to have high strength at high temperatures. Silicon carbide (SiC) is one appropriate ceramic material that can be used. Aspects that make SiC a favorable material include its high sublimation temperature, low coefficient of thermal expansion absence of phase transitions that would cause discontinuities in thermal expansion. SiC components can be manufactured using known processes, including, for example, the casting or extruding of precursor materials containing grains of SiC, followed by processing by firing, sintering, hot-isostatic-pressing, etc. Another refractory ceramic that is appropriate in some embodiments is zirconia.

In the illustrated embodiments, the support rods 512 are shown as being hollow, i.e., tubular. According to other embodiments, the support rods 512 are solid.

Flame Holder

In the illustrated embodiment, the flame holder 102 includes a plurality of burner tiles 112 that are laid in an array over the support rods 512. In a preferred embodiment, the flame holder 102 is a perforated flame holder, as described above with reference to FIGS. 2-4. Each of the burner tiles 112 is, in plan view, generally square in shape, with a thickness of about one third its lateral dimensions. Referring to FIG. 8, a blind aperture 800 extends a short distance into each burner tile 112 at the center of each vertical face of the burner tile 112, so that each burner tile 112 has four blind apertures 800. In each case where two of the burner tiles 112 are in face-to-face contact, a dowel 802 extends between the blind apertures 800 in the contacting faces. The dowels 802 are preferably sized to fit loosely in the blind apertures 800. For example, in the illustrated embodiment, the burner tiles 112 are nominally about 5.9"× 5.9", by about 2" in height. The blind apertures 800 are about ½' in diameter by about ⅝" in depth, while the dowels 802 are about ⅜" in diameter and about 1" in length. The dowels 802 are, according to an embodiment, made from the same material as the burner tiles 112. According to an alternative embodiment, the blind apertures 800 and dowels 802 are omitted, so that the burner tiles 112 are merely positioned adjacent to each other to form the array of burner tiles 112. In another embodiment, positioning each of the plurality of burner tiles 112 includes positioning each burner tile 112 to maintain at least one degree of freedom between relative positions of itself and each adjacent burner tile 112.

As best shown in the plan view of FIG. 5, an array of burner tiles 112 in eight rows of ten burner tiles 112 is positioned on the support lattice 1000 of support rods 512 and between two double rows of plate ties 606. Additional smaller arrays of burner tiles 112 are positioned on the cantilevered portions of the support lattice 1000 between one of the double rows of plate ties 606 and a respective single row of plate ties 606. Spacers made from smaller pieces of burner tiles 112 can also be used between plate ties 606 in the cantilevered portions to maintain a desired spacing of the plate ties 606. Additionally or alternatively, the support rods 512 passing through those plate ties 606 can be provided with appropriately positioned tabs 708, which, when unaligned from the respective locking features 706, will maintain the desired position.

According to various embodiments, the burner tiles 112 have shapes and proportions that differ from those of the pictured embodiment. For example, the burner tiles 112 of the flame holder 102 can be any of a number of shapes, such as square, rectangular, hexagonal, etc. Additionally, the flame holder 102 can include burner tiles 112 in a variety of different shapes and/or sizes.

When the flame holder assembly 101 is fully assembled, relative movement of the burner tiles 112 is constrained by other components of the flame holder assembly 101. For example, as noted above, tabs 708 at the ends of the support rods 512 prevent the plate tie ends 600 and plate ties 606 from dropping off the ends of the support rods 512 at the sides of the flame holder support assembly 104. The plate tie ends 600 and plate ties 606, in turn, prevent excessive sideways movement of the burner tiles 112. Movement of the burner tiles 112 toward the front or back of the flame holder support assembly 104 is controlled by one of the support rods 512 at each end, which is positioned slightly above the plane defined by the support rods 512 that rest on the second support beams 510, which prevents excessive movement of burner tiles 112 toward the ends of the flame holder support assembly 104. In the cantilevered portions, additional plate tie ends 600 and plate ties 606 are positioned so as to prevent excessive frontward or backward movement of burner tiles 112 in their direction. Finally, the dowels 802 serve to prevent significant movement of the burner tiles 112 relative to each other.

Notwithstanding the elements of the flame holder support assembly 104 that serve to limit movement of the burner tiles 112, the connections and spacing of the various elements are selected to enable a relatively large degree of movement. For example, as previously noted, each burner tile 112 is about 5.9"×5.9". Meanwhile, in the pictured embodiment, the distance between the insides of the double rows of plate ties 606 is at least 48", which means that a gap averaging about 0.1" will be present between the faces of adjacent burner tiles 112.

Operation

It will be recognized that the joints and connections of the components of the flame holder assembly 101 are configured so as to permit some movement between the components, even while maintaining the overall configuration of the structure. For example, the relatively loose fit of the support rods 512 in the keyhole apertures 602, and of the dowels 802 in the blind apertures 800 of the burner tiles 112 are discussed above. Additionally, as shown for example, in FIG. 7, the first support beams 508 and second support beams 510 are held in their relative positions by the frame rods 512*a* that extend between the plate tie ends 600, a respective one of which also passes lengthwise through each of the first support beams 508 and another respective one of which also passes through the keyhole apertures 602 at each end of the second support beams 510. Thus, movement is constrained primarily by the support rods 512 loosely positioned in the keyhole apertures 602 and by the loose fit of the support rods 512 that extend lengthwise through the first support beams 508—and also, of course, by the fact that, during normal operation, the second support beams 510 rest directly on the upper surfaces of the first support beams 508, the support rods 512 rest directly on the second support beams 510, and the burner tiles 112 rest directly on the support rods 512.

The large degree of relative movement permitted between components of the flame holder assembly 101 provides a specific type of protection to the flame holder assembly 101. During normal operation of the furnace 100, the flame holder assembly 101 is subjected to very high temperatures, as well as large differences in temperature at different locations or parts of the flame holder assembly 101. A particular concern associated with structures used in such furnaces is that temperature differences and differences in thermal expansion can result in mechanical stresses and consequent damage to such structures. These stresses can occur because of differences in the coefficient of thermal expansion of materials used, but can also occur in structures in which all of the components are made from materials having the same coefficient of thermal expansion, because the temperature of the structure will not always be the same at different locations. Thus, one component may have a higher degree of expansion than another, even if they have the same coefficient of thermal expansion. When such components are tightly connected to each another, they may be subjected to significant stresses that can shorten their useful service life. While this is particularly true during startup and shut-down operations, as temperature changes occur at different rates at different locations, significant temperature differences can also occur during normal operation, between parts of the structure that are closer to or farther from the combustion reaction, or where gases circulating in the furnace volume 111 create local hot or cool spots.

However, because of the relatively loose connections in the disclosed embodiments, uneven expansion of different elements is accommodated without stressing those or other components. It should be noted here that obtaining this benefit is not simply a matter of reducing the tightness of conventional connectors. Many known connectors are designed to be installed with a relatively loose fit, then tightened to secure the respective elements in place. Such connectors are designed to be tightened for proper operation, and failure to do so will result in unsecure connections and potential unplanned separation of the connected elements. In contrast, joints and connections described in the present disclosure are designed to maintain secure connections, even while permitting some relative movement.

Method of Assembly

There is a constant pressure on the operators of industrial furnaces to reduce undesirable emissions and improve fuel and operational efficiency. The pressure arises, for example, from tightening governmental regulations, competition, and rising fuel and operating costs. As a consequence, many operators are faced with the prospect of adopting newer technologies or shutting down a furnace long before it has reached the end of its anticipated useful life. The perforated flame holder technology described above is one of the new and emerging technologies that may provide the means of extending the useful life of many furnace systems. However, the retrofitting of an existing furnace to use such a system can be expensive. In conventional retrofits, it is often necessary to partially disassemble a furnace to permit the installation of a structure configured to support a flame holder within the furnace volume, after which it is necessary to reassembly the furnace before it can be restarted. The entire operation can take days or weeks to complete. In addition to the material and labor costs of the retrofit operation, operating revenue is lost during the retrofit process.

According to an embodiment, a method is provided that enables the on-location assembly, and installation of a flame holder assembly, such as, e.g., the flame holder assembly 101 described above, into a preexisting furnace system, without the necessity of extensive rework of existing systems. The process will be described with respect to the furnace 100 and flame holder assembly 101 of FIGS. 1 and 5-10. For clarity, elements of the illustrated embodiment will be indicated by reference number. However, other embodiments are contemplated in which the principles of the invention are employed for use where one or both of the furnace 100 and the flame holder assembly 101 vary from those described above.

Prior to beginning the installation, the furnace 100 is shut down and allowed to cool. The support brackets 106 are then installed by attaching them to the walls 500 of the furnace 100, by any appropriate means. For example, arms of the support brackets 106 can be passed from inside the furnace volume 111 through holes bored in the furnace walls 500, and, while being held at the correct position from the inside, welded to the structural layer 502 from the outside. The support brackets 106 are sized and configured to extend from the furnace side walls 500 into the furnace volume 111 without touching process tubes 108 or other heat transfer structures within the furnace 100.

Once the support brackets 106 are installed—including support pads 506 and mating elements 700—components of an initial frame are passed through the service access port 116 in the floor 110 of the furnace 100 to workers positioned inside the furnace volume 111. The initial frame includes the first and second support beams 508, 510, four plate tie ends 600, and seven frame (support) rods 512*a*. Inside the furnace volume 111, the workers assemble the initial frame in a vertical orientation, i.e., standing up, rather than in the horizontal orientation at which it will eventually operate. Two of the frame rods 512*a* are positioned within the first support beams 508, and another two of the frame rods 512*a* are passed through keyhole apertures 602 in the ends of the second support beams 510. Plate tie ends 600 are then placed over the ends of the first four frame rods 512*a* and the frame rods 512*a* are then rotated out of alignment with the keyhole apertures 602, locking the first and second support beams 508, 510 and plate tie ends 600 together. The frame rods 512*a* that extend through the keyhole apertures 602 in the second support beams 510 have a first pair of locking tabs 708 at their extreme ends, which hold the plate tie ends 600 in position. They also have a second pair of locking tabs 708 located so as to be just inward from the second support beams 510. These tabs 708 serve to prevent the second support beams 510 from sliding out of position on the frame rods 512*a* during the installation process. The initial frame is completed by positioning the remaining three frame rods 512*a* in the appropriate keyhole apertures 602 of one pair of the plate tie ends 600, then locking the frame rods 512*a* in place.

With the initial frame assembled, the workers lift the frame above the level of the support brackets 106 and position one of the first support beams 508 so that it extends between two of the support brackets 106 and rests in the channels 702 of the respective mating elements 700—in the furnace 100 shown in the drawings, the mating elements 700 are supported by the support brackets 106 at a height of about five feet above the floor 110 of the furnace 100. With one of the first support beams 510 positioned on a pair of the support brackets 106, the workers rotate the initial frame by lowering the opposite end of the frame and bringing the frame into a horizontal orientation, with the other of the first support beams 508 resting in channels 702 of mating elements 700 supported by the other two of the support brackets 106.

Once the initial frame is assembled and positioned, the remaining support rods 512 are passed through the service access port 116, a few at a time, and plate ties 606 are also passed through, as needed. Two of the frame rods 512*a* that were installed as part of the initial frame extend across the second support beams 510 and constitute the first of the support rods 512 that form the support lattice 1000 on which the burner tiles 112 will rest. A third one of the frame rods 512*a* is positioned slightly above the plane defined by the support lattice 1000, and acts as a stop to constrain the burner tiles 112. The workers inside the furnace volume 111 continue to lay the support rods 512 across the second support beams 510 and install plate ties 606 on the ends of the support rods 512 as they go.

Ends of the first two of the support rods 512 that are positioned on the assembled frame are linked together by a plate tie 606 at each end, then two more plate ties 606 are installed linking the first of those two support rods 512 with the nearest of the frame rods 512*a* installed with the initial frame, overlapping the plate tie ends 600 and the first two plate ties 606. The remaining support rods 512 are installed in the same fashion, with a pair of support rods 512 being linked together by a pair of plate ties 606, then that pair being linked to the previously installed pair by another pair of overlapping plate ties 606. Cantilevered portions of the support lattice 1000 are formed by longer support rods 512, which extend beyond the second support beams 510 at each side. These longer support rods 512 are linked to the previous support rods 512 by the double row of plate ties 606, as described previously, but they are also linked by additional plate ties 606, according to the particular design of the flame holder assembly 104. When the final two support rods 512 of the support lattice 1000 are positioned, a final pair of plate tie ends 600 are positioned on their ends, then one more support rod 512 is positioned in keyhole apertures 602 of the final plate tie ends 600 and supported above the plane of the support lattice 1000, to act as another stop, to constrain movement of the burner tiles 112.

Following completion of the flame holder support assembly 104, burner tiles 112 are arranged on the support lattice 1000 formed by the support rods 512. The support rods 512 are spaced such that each burner tile 112 rests across two of the support rods 512. The space between adjacent support rods 512 is sufficient to permit the introduction of a burner tile 112 between the support rods 512, or individual burner tiles 112 can be passed around the sides or ends of the flame holder support assembly 104 at locations where there is adequate space between the flame holder support assembly 104 and the process tubes 108 of the furnace 100. As the burner tiles 112 are placed on the support lattice 1000, the workers reach between the support rods 512 to slide each burner tile 112 into position in the array of burner tiles 112.

The space between the support rods 512 is also sufficient for the workers to reach between them and position dowels 802 between adjacent pairs of burner tiles 112. Working from underneath the flame holder support assembly 104, the workers continue to introduce burner tiles 112 and assemble the array over the flame holder support assembly 104 to complete the flame holder 102. Installation of the flame holder assembly 101 and flame holder 102 may be simplified by the loose fit of the various components. In some embodiments, the elements can be connected by hand, without the need for tools, such as mallets, wrenches, drivers, etc.

In an embodiment, positioning each of the plurality of burner tiles 112 includes positioning to maintain at least one degree of freedom between positions of each pair of the plurality of burner tiles 112, while moving the adjacent ones of the plurality of burner tiles 112 together.

As described above, each element of the flame holder assembly 101 is sized to be capable of passing through the service access port 116 and of being assembled on location within the cylindrical space defined by the plurality of process tubes 108. In the example shown in FIG. 1, the service access port 116 is about 22 inches on a side, which is adequate for a worker to enter the furnace volume 111. In other furnaces, the access port can vary in size, so that it may be larger than the service access port 116 of the illustrated example, or it may be smaller, such as, for example, 15 or 18 inches on a side. According to an embodiment, the elements of the flame holder assembly 101 are sized to pass through an access port, even in cases where the access to a furnace volume 111 is barely sufficient to admit a service worker. For example, the elements of the illustrated embodiment are capable of being passed through an opening less than 12 inches on a side. Because the flame holder assembly 101 can be introduced through a restricted passage, and assembled on location inside a furnace volume, many commercial furnaces can be quickly and inexpensively retrofitted with advanced-technology flame holders, thereby significantly improving efficiency, reducing emissions, and extending their useful service life.

In addition to those described above, various embodiments provide further advantages. For example, there are no small fasteners required and the flame holder assembly 101 can be assembled by hand, without the use of tools. This is in contrast with typical systems, in which fasteners are mechanically complex, and require various tools to complete the installation. Another significant advantage is that the burner tiles 112 are not coupled together in the array, but remain separable, even after being installed. In conventional systems where a flame holder 102 includes multiple burner tiles 112, the burner tiles 112 are bound together, using mechanical fasteners, wire, or refractory cement. This is generally necessary because the flame holder 102 is supported only around its perimeter, so that the burner tiles 112 that are not on the perimeter of the array are supported only by adjacent burner tiles 112. Consequently, in such a system if one or more of the burner tiles 112 were to break, it is difficult to remove and replace that burner tile 112 without removing the entire array—often resulting in breakage of additional burner tiles 112. Even after removing the array, it can be difficult or impossible to replace individual burner tiles 112 of the array.

Under the direction of the inventors, a flame holder assembly like the flame holder assembly 101 described above, was constructed and assembled on location, as a retrofit in a commercial processing furnace, according to a process substantially as described herein. The installation of the flame holder assembly 101 was completed in under four hours. Other modifications to the furnace 100 are possible, such as some minor changes to the fuel supply and nozzles, etc.

Figure 11A:
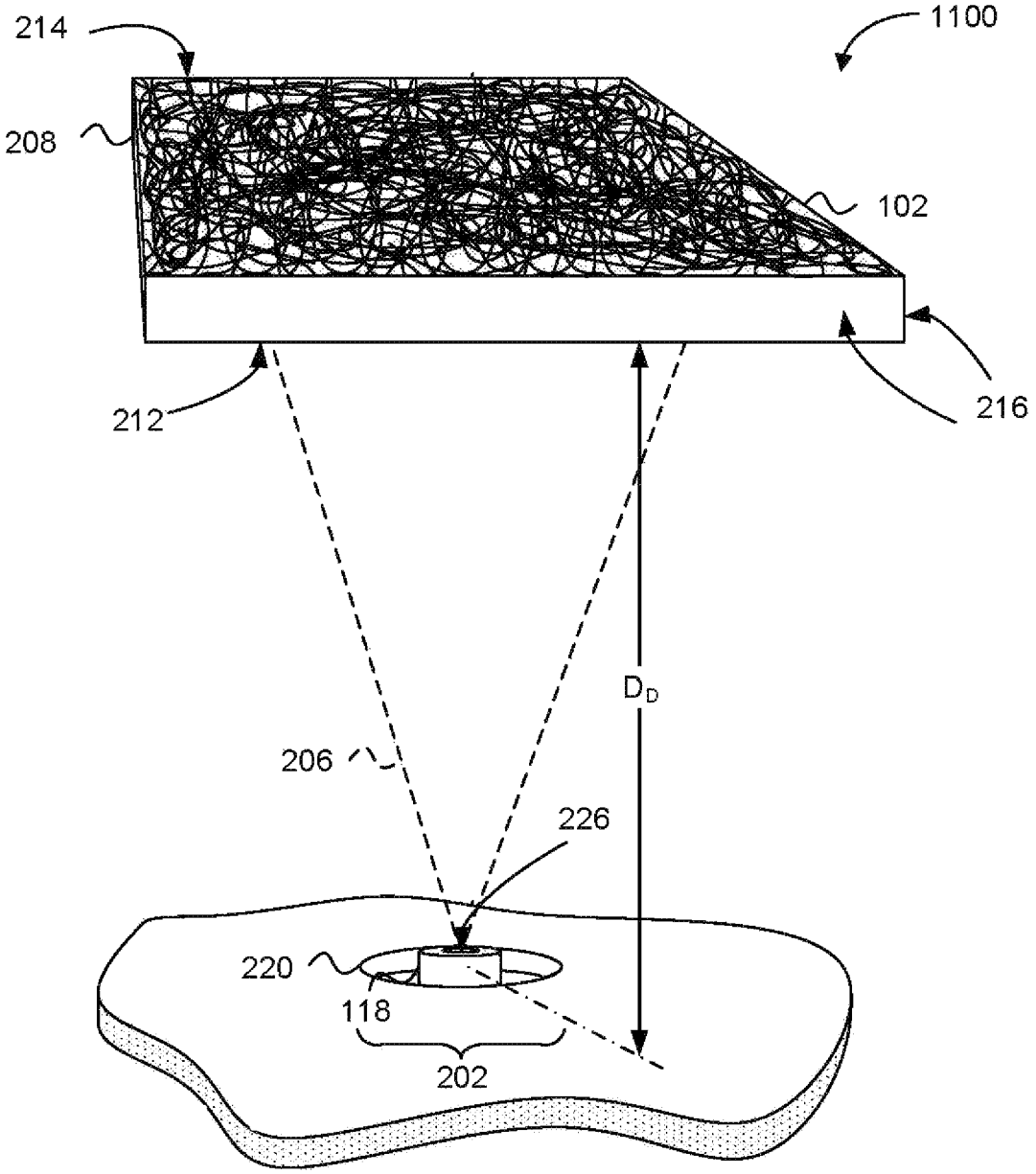
FIG. 11A is a simplified diagram of a burner system, including a perforated flame holder configured to hold a combustion reaction, according to an embodiment.
Figure 11B:
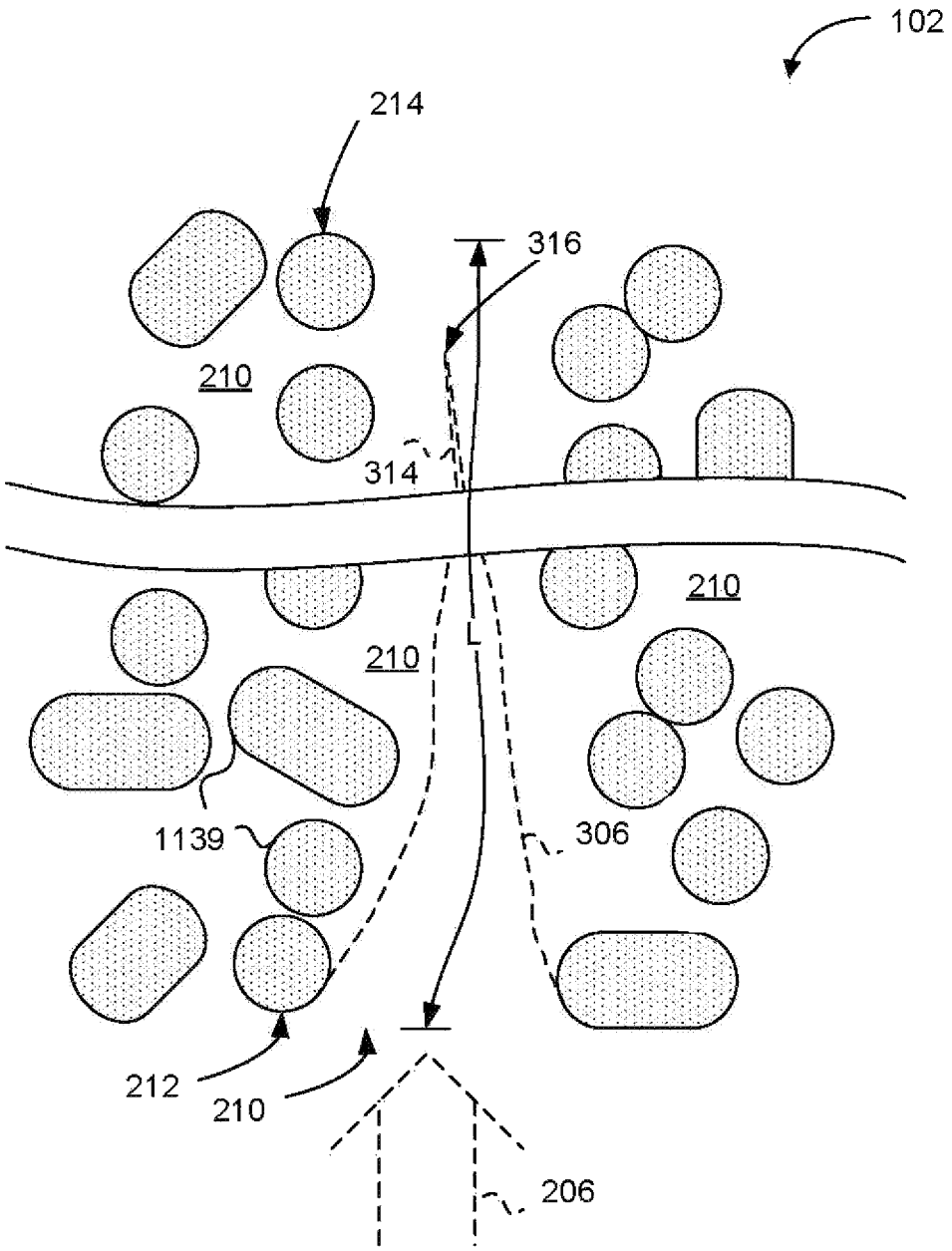
FIG. 11B is a side sectional diagram of a portion of the perforated flame holder of FIG. 11A, according to an embodiment.

FIG. 11A is a simplified perspective view of a combustion system 1100, including another alternative perforated flame holder 102, according to an embodiment. The perforated flame holder 102 is a reticulated ceramic perforated flame holder, according to an embodiment. FIG. 11B is a simplified side sectional diagram of a portion of the reticulated ceramic perforated flame holder 102 of FIG. 11A, according to an embodiment. The perforated flame holder 102 of FIGS. 11A, 11B can be implemented in the various combustion systems described herein, according to an embodiment. The perforated flame holder 102 is configured to support a combustion reaction of the fuel and oxidant 206 at least partially within the perforated flame holder 102 between an input face 212 and an output face 214. According to an embodiment, the perforated flame holder 102 can be configured to support a combustion reaction of the fuel and oxidant 206 upstream, downstream, within, and adjacent to the reticulated ceramic perforated flame holder 102. According to an embodiment, the reticulated ceramic perforated flame holder 102 can include one or more burner tiles 112. Each burner tile 112 can be a reticulated ceramic burner tile.

According to an embodiment, the perforated flame holder body 208 can include reticulated fibers 1139. The reticulated fibers 1139 can define branching perforations 210 that weave around and through the reticulated fibers 1139. According to an embodiment, the perforations 210 are formed as passages between the reticulated ceramic fibers 1139.

According to an embodiment, the reticulated fibers 1139 are formed as a reticulated ceramic foam. According to an embodiment, the reticulated fibers 1139 are formed using a reticulated polymer foam as a template. According to an embodiment, the reticulated fibers 1139 can include alumina silicate. According to an embodiment, the reticulated fibers 1139 can include Zirconia. According to an embodiment, the reticulated fibers 1139 are formed from an extruded ceramic material. According to an embodiment, the reticulated fibers 1139 can be formed from extruded mullite or cordierite. According to an embodiment, the reticulated fibers 1139 can include silicon carbide.

The term "reticulated fibers" refers to a netlike structure. In reticulated fiber embodiments, the interaction between the fuel and oxidant 206, the combustion reaction, and heat transfer to and from the perforated flame holder body 208 can function similarly to the embodiment shown and described above with respect to FIGS. 2-4. One difference in activity is a mixing between perforations 210, because the reticulated fibers 1139 form a discontinuous perforated flame holder body 208 that allows flow back and forth between neighboring perforations 210.

According to an embodiment, the reticulated fiber network is sufficiently open for downstream reticulated fibers 1139 to emit radiation for receipt by upstream reticulated fibers 1139 for the purpose of heating the upstream reticulated fibers 1139 sufficiently to maintain combustion of a fuel and oxidant 206. Compared to a continuous perforated flame holder body 208, heat conduction paths 312 between the reticulated fibers 1139 are reduced due to separation of the reticulated fibers 1139. This may cause relatively more heat to be transferred from the heat-receiving region 306 (heat receiving area) to the heat-output region 310 (heat output area) of the reticulated fibers 1139 via thermal radiation.

According to an embodiment, individual perforations 210 may extend between an input face 212 to an output face 214 of the perforated flame holder 102. Perforations 210 may have varying lengths L. According to an embodiment, because the perforations 210 branch into and out of each other, individual perforations 210 are not clearly defined by a length L.

According to an embodiment, the perforated flame holder 102 is configured to support or hold a combustion reaction or a flame at least partially between the input face 212 and the output face 214. According to an embodiment, the input face 212 corresponds to a surface of the perforated flame holder 102 proximal to the fuel nozzle 118 or to a surface that first receives fuel. According to an embodiment, the input face 212 corresponds to an extent of the reticulated fibers 1139 proximal to the fuel nozzle 118. According to an embodiment, the output face 214 corresponds to a surface distal to the fuel nozzle 118 or opposite the input face 212. According to an embodiment, the input face 212 corresponds to an extent of the reticulated fibers 1139 distal to the fuel nozzle 118 or opposite to the input face 212.

According to an embodiment, the formation of boundary layers 314, transfer of heat between the perforated reaction holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 212 to the output face 214 through the perforated reaction holder 102. According to an embodiment, the void fraction (expressed as (total perforated reaction holder 102 volume—reticulated fiber 1139 volume)/total volume)) is about 70%.

According to an embodiment, the reticulated ceramic perforated flame holder 102 is a tile about 1"×4"×4". According to an embodiment, the reticulated ceramic perforated flame holder 102 includes about 10 pores per inch, meaning that a line laid across a surface of the reticulated ceramic perforated flame holder 102 crosses about 10 pores per inch. Other materials and dimensions can also be used for a reticulated ceramic perforated flame holder 102 in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic burner tiles 112. The multiple reticulated ceramic tiles 112 can be joined together such that each reticulated ceramic burner tile 112 is in direct contact with one or more adjacent reticulated ceramic tiles 112. The multiple reticulated ceramic tiles 112 can collectively form a single perforated flame holder 102. Alternatively, each reticulated ceramic burner tile 112 can be considered a distinct perforated flame holder 102.

As used herein, the term assembled on location, and variations thereof, refers to the assembly of a structure at the location where it is to be used, i.e., within the furnace volume of a furnace in which it will be operated, from elements that are transported to the location as unassembled components. This is in contrast to a system in which elements are substantially assembled outside a furnace volume, then transported to the location where the system will be used, with only minimal assembly being performed at the site.

Ordinal numbers, e.g., first, second, third, etc., are used in the claims according to conventional claim practice, i.e., for the purpose of clearly distinguishing between claimed elements or features thereof. The use of such numbers does not suggest any other relationship, such as order of operation or relative position of such elements, etc. Furthermore, an ordinal number used to refer to an element in a claim does not necessarily correlate to a number used in the specification to refer to an element of a disclosed embodiment on which that claim reads, nor to numbers used in unrelated claims to designate similar elements or features.

According to an embodiment, the reticulated ceramic perforated flame holder 102 can include one or more burner tiles 112. Each burner tile 112 can be a reticulated ceramic burner tile.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system, comprising:

a support structure configured to support a plurality of burner tiles within a furnace volume, the support structure including:

a frame including frame members configured to be assembled on location; and a support lattice having a plurality of support members sized to span the frame and configured to be assembled on location with the frame;

a flame holder, including the plurality of burner tiles configured to be assembled into an array on location, supported within the furnace volume by the support lattice;

a furnace having a furnace wall extending around and defining the furnace volume; and a plurality of support brackets coupled to the furnace wall and extending into the furnace volume, the frame being supported within the furnace volume by the plurality of brackets.

2. The system of claim 1, wherein the furnace wall includes a floor, the floor having a service access port sized to permit human access to the furnace volume, and wherein the frame members and support members are sized to pass through the service access port.

3. The system of claim 2, wherein the frame members, the support members, and the burner tiles are each sized to pass through a passage having a dimension of no more than 22 inches on a side.

4. The system of claim 3, wherein the plurality of burner tiles are separably arranged in an array on the support lattice.

5. The system of claim 3, comprising a plurality of dowels each positioned between a respective adjacently positioned pair of the plurality of burner tiles and extending from an aperture formed in a face of one of the pair of burner tiles into an aperture formed in a face of the other of the pair of burner tiles.

6. The system of claim 1, wherein:

the support structure includes a plurality of connecting members; and the frame members include a first plurality of frame members extending parallel to a first axis and a second plurality of frame members extending parallel to a second axis, perpendicular to the first axis, and wherein each of the first plurality of frame members is configured to lockingly engage a respective one of the plurality of connecting members at first and second ends thereof.

7. The system of claim 6, wherein each of the plurality of connecting members includes a locking aperture, and wherein the first and second ends of each of the first plurality of frame members are configured to pass into and lockingly engage the locking aperture of the respective ones of the plurality of connecting members.

8. The system of claim 7, wherein the first and the second ends of each of the first plurality of frame members are configured to pass into the locking aperture of the respective ones of the plurality of connecting members with a clearance of at least ten percent of a diameter of the first and the second ends.

9. The system of claim 7, wherein:

each of the first plurality of frame members includes a locking tab at each of the first and the second ends thereof;

the locking aperture of each of the plurality of connecting members has a keyhole shape configured to receive an end of one of the first plurality of frame members at a particular orientation; and while the end of one of the first plurality of frame members is received in the aperture of one of the plurality of connecting members, rotation of the one of the first plurality of frame members relative to the one of the plurality of connecting members away from the particular orientation locks the end of the one of the first plurality of frame members in the aperture of the one of the plurality of connecting members.

10. The system of claim 9, wherein each of the plurality of connecting members includes a plurality of locking apertures.

11. The system of claim 6, wherein each of the plurality of support members is configured to lockingly engage a respective one of the plurality of connecting members at the first and the second ends thereof.

12. The system of claim 11, wherein the plurality of connecting members includes the connecting members configured to couple adjacent pairs of the plurality of support members together.

13. The system of claim 11, wherein the plurality of connecting members includes plates sized to extend beyond a plane defined by the support members of the support lattice.

14. The system of claim 1, wherein the frame, the support lattice, and the flame holder are each configured to be assembled by hand without the use of hand tools.

15. The system of claim 1, wherein the frame, the support lattice, and the flame holder are each made entirely of refractory ceramic.

16. The system of claim 15, wherein the frame and the support lattice are each made entirely of silicon carbide.

17. The system of claim 15, wherein the flame holder is made entirely of cordierite.

18. The system of claim 1, wherein one or more of the burner tiles is a bluff body burner tile.

19. The system of claim 18, wherein one or more of the bluff body burner tiles is a solid burner tile.

20. The system of claim 18, wherein one or more of the bluff body burner tiles is a perforated burner tile.

21. The system of claim 20, wherein one or more of the burner tiles is a reticulated ceramic burner tile.

22. The system of claim 21, wherein the reticulated ceramic burner tile includes a plurality of reticulated fibers.

23. The system of claim 22, wherein the reticulated ceramic burner tile includes zirconia.

24. The system of claim 22, wherein the reticulated ceramic burner tile includes alumina silicate.

25. The system of claim 22, wherein the reticulated ceramic burner tile includes silicon carbide.

26. The system of claim 22, wherein the reticulated fibers are formed from extruded mullite.

27. The system of claim 22, wherein the reticulated fibers are formed from cordierite.

28. The system of claim 22, wherein the reticulated ceramic burner tile includes about 10 pores per inch.

29. The system of claim 22, wherein the reticulated ceramic burner tile includes:

an input face;

an output face; and a plurality of perforations extending between the input face and the output face.

30. The system of claim 22, wherein the perforations are formed as passages between the reticulated fibers.

31. The system of claim 30, wherein the perforations are branching perforations.

32. A method, comprising:

assembling a support structure inside of a furnace volume, including:

assembling a frame inside the furnace volume, supporting the frame within the furnace volume, and assembling a support lattice on the supported frame;

positioning each of a plurality of burner tiles on the support lattice; and separably arranging the plurality of burner tiles into an array on the support lattice;

wherein the step of separably arranging the plurality of burner tiles into an array on the support lattice comprises reaching between the support members from below the support lattice and moving each of the plurality of burner tiles into a respective position in the array.

33. The method of claim 32, wherein the assembling the frame comprises:

orienting each of a first plurality of frame members to lie parallel to a first axis;

orienting a second plurality of frame members to lie parallel to a second axis, perpendicular to the first axis;

passing first ends of ones of the first plurality of frame members into apertures in a first one of the second plurality of frame members;

passing second ends of the ones of the first plurality of frame members into apertures in a second one of the second plurality of frame members;

lockingly engaging the first ends of the ones of the first plurality of frame members to respective connecting members; and lockingly engaging the second ends of the ones of the first plurality of frame members to respective connecting members.

34. The method of claim 33, wherein the lockingly engaging the first ends of the ones of the first plurality of frame members to respective connecting members comprises:

aligning a locking feature of each of the first ends of the ones of the first plurality of frame members with a corresponding locking feature of respective connecting members;

passing the first ends of the ones of the first plurality of frame members into apertures in the respective connecting members; and unaligning the locking feature of each of the first ends by rotating each of the ones of the first plurality of frame members around respective longitudinal axes.

35. The method of claim 32, wherein the assembling a support lattice on the frame comprises:

positioning a plurality of support members parallel to a common axis and spanning the frame;

coupling first ends of adjacent pairs of the plurality of support members together by lockingly engaging the first ends of each adjacent pair of the plurality of support members to a respective one of a plurality of connecting members; and coupling second ends of the adjacent pairs of the plurality of support members together.

36. The method of claim 35, wherein the assembling a support lattice on the frame further comprises:

coupling the first end of one of each adjacent pair of the plurality of support members to the first end of one of another of the adjacent pairs of the plurality of support members.

37. The method of claim 32, wherein:

the step of positioning each of a plurality of burner tiles on the support lattice comprises passing each of the plurality of burner tiles edgewise between adjacent support members of the support lattice, from below the support lattice to above the support lattice, and rotating each of the burner tiles above the support lattice so as to span the pairs of the support members.

38. The method of claim 32, wherein:

the step of separably arranging the plurality of burner tiles into an array on the support lattice further comprises positioning each of the plurality of burner tiles to maintain at least one degree of freedom between positions with respect to each adjacent burner tile.

39. The method of claim 32, comprising passing each component of the support structure through a service port in a housing of the furnace.

40. The method of claim 39, wherein the passing each component of the support structure through a service port in a housing of the furnace comprises passing each component of the support structure through a service port whose dimensions are no greater than 22 inches on a side.

41. The method of claim 32, wherein the assembling a support structure inside of a furnace volume comprises assembling a support structure inside of a furnace volume by hand and without the use of hand tools.

42. The method of claim 32, wherein one or more of the burner tiles is a bluff body burner tile.

43. The method of claim 42, wherein the bluff body burner tile is a solid burner tile.

44. The method of claim 42, wherein the bluff body burner tile is a perforated burner tile.

45. The method of claim 44, wherein the perforated burner tile is a reticulated ceramic burner tile.

46. A system, comprising:

a support structure configured to support a plurality of burner tiles within a furnace volume, the support structure including:

a frame including frame members configured to be assembled by hand and fastened together without the use of hand tools;

a support lattice having a plurality of support members sized to span the frame and configured to be assembled with the frame by hand and fastened together without the use of hand tools; and a flame holder including a plurality of bluff body burner tiles supported by the support lattice.

47. A system, comprising:

a support structure configured to support a plurality of burner tiles within a furnace volume, the support structure including:

a frame including frame members made entirely of refractory ceramic;

a support lattice having a plurality of support members sized to span the frame, made entirely of refractory ceramic; and a plurality of connecting members configured to couple the frame members and the support members together, the connecting members being made entirely of refractory ceramic;

wherein each of the plurality of connecting members includes a plurality of keyhole apertures, and ones of the frame members and the support members include features configured to lockingly engage corresponding keyhole apertures of the connecting members.

48. The system of claim 47, comprising a flame holder, including a plurality of burner tiles arranged in an array and supported by the support lattice, and made entirely of refractory ceramic.

* * * * *